United States Patent [19]

Reim et al.

[11] 4,289,228

[45] Sep. 15, 1981

[54] CONVEYING DEVICE FOR A PACKING MACHINE OR THE LIKE

[75] Inventors: Werner Reim, Waldbronn; Hermann Gernlein; Helmuth Zimmermann, both of Karlsruhe, all of Fed. Rep. of Germany

[73] Assignee: Industrie-Werke Karlsruhe Augsburg Aktiengesellschaft, Fed. Rep. of Germany

[21] Appl. No.: 101,298

[22] Filed: Dec. 6, 1979

[30] Foreign Application Priority Data

Dec. 8, 1978 [DE] Fed. Rep. of Germany ..... 2853103

[51] Int. Cl.[3] ..... B65G 47/00

[52] U.S. Cl. ..... 198/339; 198/472

[58] Field of Search ..... 198/339, 472, 580, 409, 198/412, 648, 741, 742; 141/171, 282; 53/252, 564, 565, 251

[56] References Cited

U.S. PATENT DOCUMENTS 3,478,859 11/1969 Krempel et al. ..... 198/741

4,014,428 3/1977 Ossbahr ..... 198/472

FOREIGN PATENT DOCUMENTS 922510 1/1955 Fed. Rep. of Germany ..... 198/580

2823331 12/1979 Fed. Rep. of Germany ..... 198/472

*Primary Examiner*—Joseph E. Valenza

*Attorney, Agent, or Firm*—McGlew and Tuttle

[57] ABSTRACT

A device for the intermittent conveyance of receptacles for receiving packing or filling material in an intermittently operating machine, particularly a tube filling and closing machine, comprising, first and second parallel spaced apart linear guideways facing at angles to each other and a plurality of sets, each adapted for receiving one of the receptacles, slidably mounted on the first and second guideways. A driving unit is provided for moving the cassettes linearly along the guideways and for tilting and displacing the cassettes from one guideway to the other when each cassette reaches the end of the one guideway. The cassettes thus execute a cyclic movement along the first and second guideways.

8 Claims, 12 Drawing Figures

CONVEYING DEVICE FOR A PACKING MACHINE OR THE LIKE

FIELD AND BACKGROUND OF THE INVENTION

The present invention relates to conveying devices in general and, in particular, to a new and useful device for the intermittent conveyance of articles, in particular, receptacles to be filled by packing or filling material.

In order to be able to fill and close packing tubes and the like economically, by using tube filling and closing machines, it is very important to feed and remove these receptacles which receive the filling material as uniformly as possible and in regular intervals. For this purpose, it is known to use (auxiliary) device which work on either the turntable, conveyor belt, conveyor chain or the oval rubber principle. However, there are certain conceptual as well as constructional limitations to these designs and they therefore can no longer be optimized and can be improved to only a relatively limited extent.

SUMMARY OF THE INVENTION

An object of the present invention is to provide a conveying device which is simple, safe, compact and also saves unnecessary work done against the force of gravity, and which ensures trouble-free conveyance of the receptacles or articles.

The problems of the prior art are solved, according to the invention, in that a plurality of cassettes, serving to receive the receptacles, are arranged on two spaced parallel linear guideways which face at an angle to each other and which are substantially staggered in height. Means are provided to cyclically move the cassettes on the guideways and mechanical means are provided which transpose or tilt the cassettes from one guideway to the other, where the linear displacement of the cassettes or their transposition or tilting from one guideway to the other is effected by at least one drive.

In one embodiment of the invention, the mechanical means is formed substantially of arms or the like, which are rotatably mounted about a common axle on both sides to the direction of conveyance of the cassettes, and whose rotary movements take place at a right angle to the guideways.

The present invention offers a number of advantages: The conveying device is rather simple in design and operation, and has relatively high efficiency and safety. Apart from the advantages resulting from the constructional linear concept, there are other advantages which ensure complete protection of the guideways against incorrect fillings, etc., so that cleaning problems which interrupt the operation and which are otherwise practically unavoidable, do not exist here. Finally, the separate drives or driving directions have an extremely advantageous effect, because they permit optimum division of the periods for the linear displacement of the cassettes, on the one hand, and for their transposition or tilting from one guideway to the other, on the other hand. This division leads to a considerable reduction of the total conveying time, and thus finally to the desired increased output of the device.

Accordingly, another object of the present invention is to provide a device for the intermittent conveyance of articles, comprising, first and second parallel spaced apart linear guideways facing at angles to each other, a plurality of cassettes, each adapted to receive an article, slidably mounted on the first and second guideways, and means for intermittently displacing the cassettes linearly along the guideways and for tilting the cassettes from one of the guideways to the other of the guideways, whereby, the cassettes move cyclically on the device.

A further object of the present invention is to provide a conveying device for a packing machine or the like which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
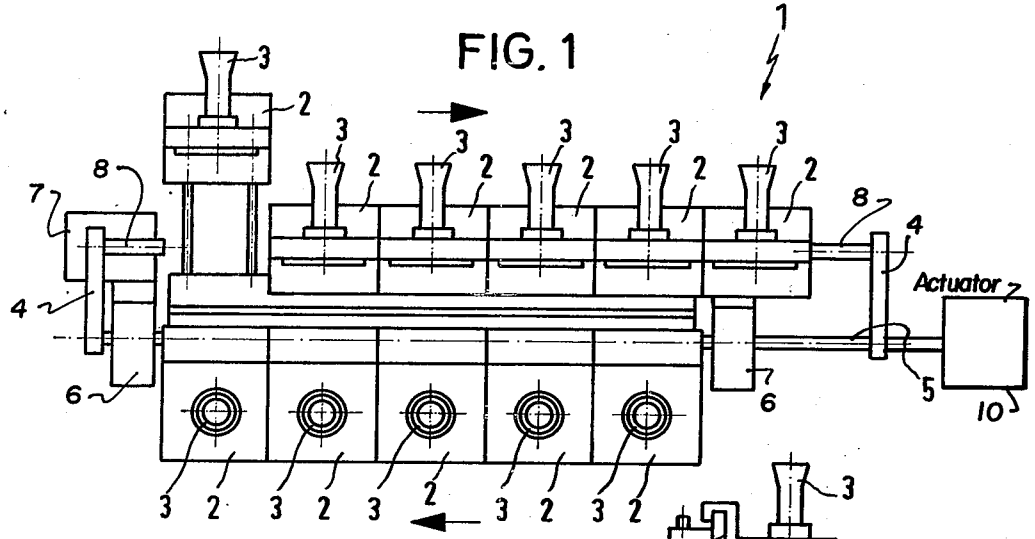
FIG. 1 is a front view of the conveying device, in accordance with the invention.

Referring to the drawings in particular, the invention embodied therein, includes a conveying device, generally designated 1, which comprises upper and lower guideways 1*a* and 1*b*, respectively, which face at angles to each other. On these two parallel linear guideways, which are at different heights, a plurality of cassettes 2 are guided successively. Cassettes 2 serve to receive receptacles 3, e.g., tubes, etc., which are to be filled with filling material in a tube filling and closing machine, which has not been shown. Arms 4 and 6 affect the transposition and tilting of cassettes 2 from one guideway to the other (1*a* to 1*b* and 1*b* to 1*a*, respectively).

Figure 2:
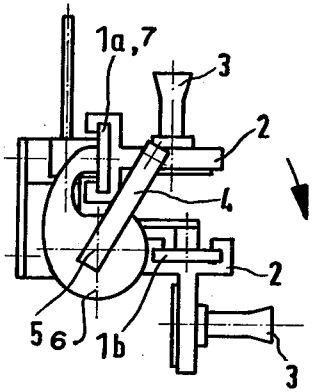
FIGS. 2, 3 and 4 are views of a swivel arm of the conveying device in a side elevation and in different operating phases.

The righthand part of FIG. 1 and all of FIG. 2 show the conveying device 1 at the start of the transposition of the righthand upper cassette 2 from upper guideway 1*a* to lower guideway 1*b*. The other cassettes 2 temporarily stand still.

Figure 3:
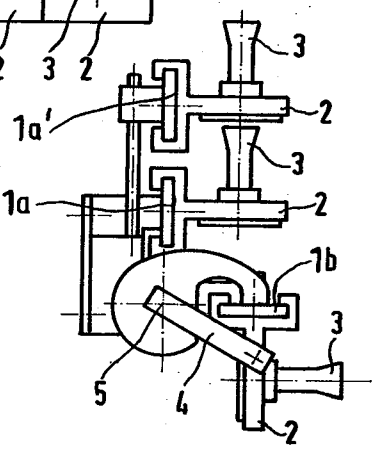

The lefthand part of FIG. 1 shows, in connection with FIG. 3, conveying device 1 in an operating phase in which the transposition of the righthand upper cassette 2 is completed, while the lefthand upper cassette 2 is still raised for filling. In this operating phase, cassette 2, carrying an unfilled tube 3, moves relatively rapidly upwardly into the filling position, while the previously filled tube 3, with its cassette 2, is tilted gently and transferred more slowly into the lower guideway 1*b*. These two movements take place at different speeds. They are variable with respect to each other within defined limits, without changing the total speed of the device.

As shown in the lefthand side of FIG. 1 and in FIG. 3, at least a part 1*a*′ of upper guideway 1*a* is raised for filling together with the associated cassette 2 and tube 3, as described above, and then lowered again after filling by suitably provided means (not shown). The raising and subsequent lowering of a part of upper guideway 1*a* with cassette 2 and tube 3 is feasible not only for the filling operation, but, in an analogous application of this measure, another part of the guideway could be raised and then lowered again, for example, for closing a tube 3, or for forming a closing groove.

Figure 4:
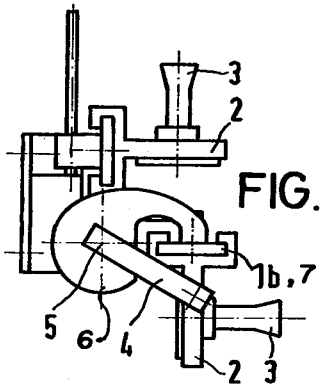

FIG. 4 shows conveying device 1 in an operating phase which corresponds to the end of the transfer of cassette 2 with tube 3 to lower guideway 1*b*.

Arms 4 and 6 which serve to transpose and tilt cassette 2 with tube 3, are rotatably mounted with and on an axle 5. They rotate at a right angle to guideways 1*a*, 1*b*. Axle 5, forming the fulcurms of arms 4, is at a very small distance from the center of gravity of cassette 2 with receiving tubes 3.

According to the embodiment of the invention shown, the cassettes 2 are moved in a cyclical manner on the guides 1*a* and 1*b* by an actuator 10 shown connected to the axle or shaft 5. Actuator 10 intermittently moves the shaft 5 to the left or right and rotates the shaft either clockwise or counterclockwise to move the cassettes 2. Cassettes 2 are moved to the left or to the right by shaft 5 which carries arm 4 which, in turn, carries a stop post 8. Shaft 5 has two arms 4 mounted at opposite sides thereof, each with a stop post 8 for displacing the top plurality of cassettes 2 to the right when shaft 5 is moved to the right causing the lefthand stop post 8 to abut against the upper left cassette 2 and cause the row of cassettes to move to the right. The lower row of cassettes 2 are moved to the left when shaft 5 is rotated to bring arms 4 into their lower position. Shaft 5 is then moved to the left causing the righthand stop post 8 to abut against the lower right cassette 2 and cause the entire lower row of cassettes to move to the left.

A pair of arms 6 are mounted to permit the sliding of shaft 5 therethrough but are mounted to rotate with the shaft 5. As seen in FIGS. 1 and 2, each arm 6 includes a guideway portion 7 which is alignable with the upper and lower guideways 1*a* and 1*b*, respectively. When arms 6 are in the position shown in FIG. 4, the actuator 10 displaces the lower row of cassettes 2 to the left which causes the lower left cassette 2, shown in FIG. 1, to be slid over the guideway portion 7. Arms 6 thus tilt and displace each of the cassettes from one of the guideways to the other.

FIGS. 5 to 8, to be described below, serve to illustrate the sequential steps of operation in the present invention.

Figure 5:
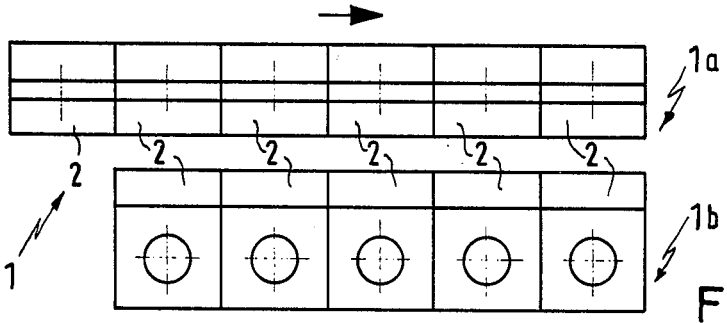
FIGS. 5, 6, 7 and 8, 5*a*, 6*a*, 7*a* and 8*a* are partial views, similar to FIG. 1, showing the conveying device, according to FIG. 1, in a schematic representation and in different operating phases.
Figure 5A:
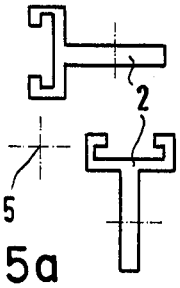

In FIG. 5, conveying device 1 is in its neutral or starting position with an upper left cassette 2 supported on guideway portion 7 of arm 6 and over lower guideway 1*b*.

Compared to FIG. 5, the cassettes in FIG. 2 have already been displaced on upper guideway 1*a* to the right by one cassette width, before the upper right cassette 2, projecting on the right side, is transposed or tilted onto the lower guideway portion of the lefthand arm 6.

Figure 6:
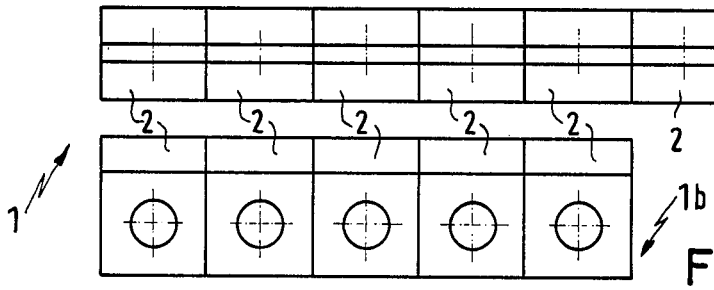
Figure 6A:
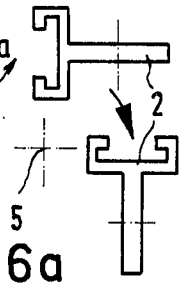
Figure 7:
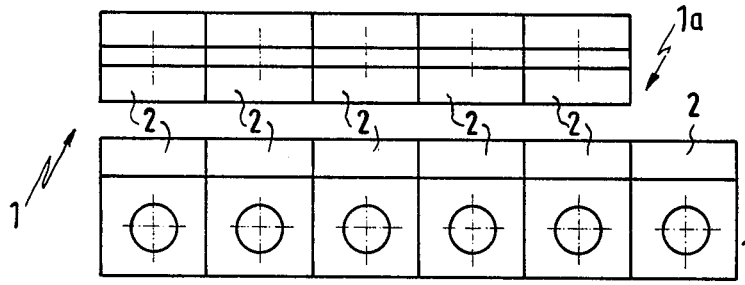
Figure 7A:
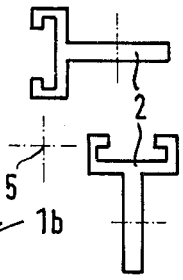
Figure 8:
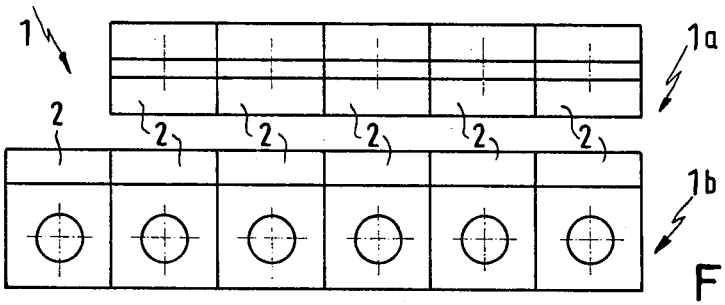
Figure 8A:
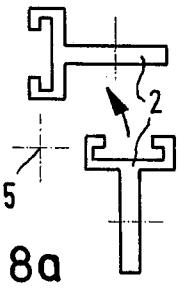

In FIG. 6, cassettes 2 temporarily stand still on lower guideway 1*b*. In FIG. 8, cassettes 2 stand still on upper guideway 1*a*, when cassettes 2 on lower guideway 1*b* have been displaced by one cassette width to the left.

After this operation is completed, the upper cassette on the left is transposed or tilted upward, as seen in FIG. 5. The above-described cycle is repeated continuously in an intermittent manner.

While a specific embodiment of the invention has been shown and described in detail to illustrate the application of the principles of the invention, it will be understood that the invention may be embodied otherwise without departing from such principles.

What is claimed is:

1. A device for the intermittent conveyance of articles, comprising first and second parallel spaced apart linear guideways facing at an angle to each other, a plurality of cassettes, each adapted to receive an article slidably mounted on said first and second guideways, and means for intermittently displacing said cassettes linearly along said guideways and for tilting said cassettes from one of said guideways to the other, whereby said cassettes move cyclically on the device, said means for intermittently displacing and tilting said cassettes comprising a shaft extending parallel to said first and second guideways, an actuator for moving said shaft linearly along its axis and for rotating said shaft about its axis, and arm means connected at each end of said shaft and engageable with said cassettes for displacing and tilting said cassettes.

2. A device for the intermittent conveyance of articles, as claimed in claim 1, wherein said axis is mounted close to a center of gravity of the cassettes.

3. A device for the intermittent conveyance of articles, as claimed in claim 1, wherein each of said arm means comprises a first arm connected to each end of said shaft rotatable and movable therewith to displace said cassettes linearly along said first and second guideways and a second arm on each side of said first and second guideways for slidably receiving said shaft and rotatable with said shaft for tilting said cassettes from one of said guideways to the other of said guideways.

4. A device for the intermittent conveyance of articles, as claimed in claim 3, wherein each of said second arms includes a guideway portion alignable with said first and second guideways, respectively, for receiving cassettes therefrom.

5. A device for the intermittent conveyance of articles, as claimed in claim 1, wherein each cassette is tilted from said first guideway to said second guideway at a different speed than when it is tilted from said second guideway to said first guideway.

6. A device for the intermittent conveyance of articles, as claimed in claim 1, wherein said first guideway includes at least a portion for carrying a single cassette which is mounted for displacement out of line with the remainder of said first guideway to raise an article received on said cassette.

7. A device for the intermittent conveyance of receptacles for receiving packing and filling material in an intermittently operated machine, particularly a tube filling and closing machine, comprising a first linear guideway, a plurality of cassettes slidably mounted on said first linear guideway and facing in a first direction, each adapted to receive a receptable, a second linear guideway parallel to said first linear guideway and spaced therefrom at a position forward of said below said first guideway, a plurality of said cassettes slidably mounted on said second linear guideway facing at an angle to said cassettes on said first guideway, and drive means connected to said first and second guideways for displacing said plurality of cassettes linearly along said first and second guideways and for tilting said cassettes when each of said cassettes reaches an end of said first and second guideway from one of said first and second guideways to the other of said first and second guideways, said drive means comprising an axle extending parallel to said first and second guideways and displaceable linearly along its axis and radially around its axis, a pair of first arms connected at opposite ends of said axle and rotatable therewith for abutment against said cassettes on said first guideway in a first position thereof and abuttable against said cassettes on said second guideway in a second position thereof for moving said cassettes linearly along said first and second guideways, and second arms connected at each side of said first and second guideways and slidably carrying said axle and rotatable with said axle for tilting said cassettes from one of said first and second guideways to the other of said first and second guideways.

8. A device, as claimed in claim 7, wherein said cassettes are tilted from said first to said second guideway at a rate slower than they are tilted from said second to said first guideway, the receptacles being filled when supported on said cassettes of said first guideway.

* * * * *